United States Patent [19]

Patel et al.

[11] Patent Number: 4,675,097

[45] Date of Patent: Jun. 23, 1987

[54] PROCESS FOR PRODUCTION OF HYDROGENATED LIGHT HYDROCARBONS BY TREATMENT OF HEAVY HYDROCARBONS WITH WATER AND CARBON MONOXIDE

[75] Inventors: Kundanbhai M. Patel, Landing; Alex Y. Bekker, Teaneck; Andiappan K. S. Murthy, Morris Township, Morris County; Fredrick J. Gefri, Hackettstown, all of N.J.

[73] Assignee: Allied Corporation, Morris Township, Morris County, N.J.

[21] Appl. No.: 687,712

[22] Filed: Dec. 31, 1984

[51] Int. Cl.[4] ..... C10G 47/04; C10G 47/06; C10G 47/32

[52] U.S. Cl. ..... 208/112; 208/124

[58] Field of Search ..... 208/112, 124; 423/656

[56] References Cited

U.S. PATENT DOCUMENTS

| | | | |
|---|---|---|---|
| 3,249,529 | 5/1966 | Viles | 208/120 |
| 3,586,621 | 6/1971 | Pitchford et al. | 208/112 |
| 3,676,331 | 7/1972 | Pitchford | 208/112 |
| 3,728,252 | 4/1973 | Pitchford | 208/243 |
| 3,960,706 | 6/1976 | McCollum et al. | 208/108 |
| 4,097,364 | 6/1978 | Egan | 208/111 |
| 4,316,794 | 2/1982 | Schoennagel | 208/108 |
| 4,381,993 | 5/1983 | Nevitt | 208/217 |
| 4,399,023 | 8/1983 | Suzuka et al. | 208/112 |

*Primary Examiner*—Olik Chaudhuri

*Attorney, Agent, or Firm*—Gale F. Matthews; Richard C. Stewart; Gerhard H. Fuchs

[57] ABSTRACT

A process for converting heavy hydrocarbon into light hydrocarbon which comprises contacting heavy hydrocarbon having an API gravity at 25° C. of less than about 20, such as Boscan heavy crude oil and tar sand bitumen, with a liquid comprising water, and carbon monoxide in the presence of an externally added catalyst comprising a mixture of sulfur and at least one of ferric oxide, ferric sulfide, ferrous sulfide and pyrite a residue and a phase comprising light hydrocarbon, gas and water; separating the residue and said phase; and recovering from said phase light hydrocarbon having an API gravity at 25° C. of greater than about 20, and having a hydrogen to carbon mole ratio greater than that of the heavy hydrocarbon feedstock.

3 Claims, No Drawings

PROCESS FOR PRODUCTION OF HYDROGENATED LIGHT HYDROCARBONS BY TREATMENT OF HEAVY HYDROCARBONS WITH WATER AND CARBON MONOXIDE

BACKGROUND OF THE INVENTION

1. Field of the Invention

The present invention relates to a process for converting heavy hydrocarbons into light hydrocarbons. More particularly, the present invention is directed to a process of treating heavy hydrocarbons containing organometallics, for example vanadium and nickel, organosulfur and organonitrogen compounds, with water and carbon monoxide at elevated temperatures and pressures, in the presence of externally added catalysts for a time sufficient to form a light hydrocarbon product, substantially free of vanadium and nickel, a gaseous product and a residue.

2. Prior Art

There exists enormous quantities of heavy hydrocarbons such as heavy petroleum crude oils and tar sand bitumen (the heavy hydrocarbons extracted from tar sands), as well as residual heavy hydrocarbon fractions obtained from heavy hydrocarbon crudes such as atmospheric tower bottoms products, vacuum tower bottoms products, crude oil residuum and heavy vacuum gas oils. These heavy crude and residual hydrocarbon streams contain large amounts of organometallic compounds, especially those containing nickel and vanadium, organosulfur and organonitrogen compounds, and asphaltenes (high molecular weight polycyclic, pentane insoluble materials). Such heavy crude and residual hydrocarbons are viscous, accordingly they require a greater degree of processing to convert them into liquid materials that can be transported easily.

A number of alternative physical and chemical routes have been and are still being developed for converting heavy hydrocarbon materials into lighter liquid and gaseous fuels. Among the approaches are physical separation processes, such as vacuum distillation, steam distillation, and solvent deasphalting; and various thermal conversion processes such as visbreaking, delayed coking, fluid coking and coke gasification; catalytic processes such as hydrotreating, hydrorefining and hydrocracking; and multistage catalytic and non-catalytic processes.

Each of these approaches have one or more drawbacks. In physical separation processes such as vacuum distillation, steam distillation and solvent deasphalting, a liquid hydrocarbon fraction is recovered in low yield but the asphaltene and resinous materials are not converted into product and must be disposed of separately. The various thermal conversion processes such as visbreaking, delayed coking, fluid coking and coke gasification require high temperatures above 500° C. and generate a low quality by-product coke. In coke gasification, treatment of heavy hydrocarbons with steam and oxygen at high temperatures is necessary to produce a product gas, which must be utilized locally, and a limited yield of lighter liquid hydrocarbon product. Recently, a thermal conversion process called the Eureka process was disclosed in Chemical Engineering, Feb. 1981, pages 37–44 and in U.S. Pat. No. 4,242,196. The Eureka process converts petroleum residues, such as mixtures of vacuum residues from Khafij crude oil, or Iranian heavy crude oil, into a low sulfur petroleum oil and petroleum pitch by preheating the mixture of vacuum residues to about 450° C. to 520° C., feeding the preheated mixture to a fractionator and then to a charge heater at 500° C. before stripping the thermally cracked low molecular weight hydrocarbons with superheated steam in a delayed coker reactor at 420° C. to 430° C. under atmospheric pressure. Catalytic hydrogenation processes such as hydrotreating, hydrorefining, and hydrocracking may be used for converting heavy hydrocarbon feedstocks into a good quality material in high yield. However, the hydrogenation catalyst employed in each of these processes is rapidly poisoned by the exceedingly large amounts of organometallic compounds and asphaltenic material in the heavy hydrocarbon feedstocks. The high levels of organometallic compounds in the feedstocks interfere considerably with the activity of the catalyst with respect to destructive removal of nitrogen and sulfur and oxygenated compounds. As a result, more than 3 kilograms of catalyst is consumed per 1000 kilograms of oil processed.

The prior art has also converted organic heavy hydrocarbons and other organic liquids to fuels by reaction with water. U.S. Pat. No. 4,113,446 (Modell et al.) discloses that liquid or solid organic materials can be converted into high BTU gas, with little or no formation of undesirable char or coke, when organic material is reacted with water at a temperature at or above the critical temperature of water and at or above the critical pressure of water to achieve the critical density of water. While U.S. Pat. No. 4,113,446 discloses that the process may be conducted either in the presence or absence of a catalyst, only gas and no liquid hydrocarbon fractions are recovered. International Publication No. WO 81/00855 (corresponding to U.S. Pat. application Ser. No. 079,534 filed Sept. 29, 1979, by M. Modell) discloses that organic solid or liquid material is admixed with water (in the region of the critical density of water, i.e., densities of water from 0.2 to 0.7 gms/cm$^3$) at pressures from 200–2500 atmospheres and at temperatures from 374° C. to at least about 450° C. to restructure the organic materials to form useful volatile organic liquids.

U.S. Pat. No. 3,983,027 (McCollum et al.) discloses a process for cracking, desulfurizing and demetallizing heavy hydrocarbon feedstocks such as vacuum gas oil, tar sand oils and atmospheric residual oils to produce gases, liquids (heavy ends and light ends), and a solid residue by contacting the heavy hydrocarbons with a dense-water containing fluid at a temperature in the range of 2500 psig to 4400 psig in the absence of an externally supplied catalyst and hydrogen or other reducing gas. The density of water in the dense-water containing fluid was at least about 0.1 g/mL, and sufficient water was present to serve as an effective solvent for recovered liquids and gases. However, in the examples which disclose a process for removal of vanadium and nickel, straight tar sands having no more than 256 ppm of vanadium and nickel were treated with water at 400° C. and 4100–4350 psig (28249–29972 kPa) for at least one hour. To produce a hydrocarbon product having an API density of 21 and low (10 ppm) nickel and vanadium content, the presence of alundum balls in the reaction zone at 400° C. and 4100 psig and extremely low flow rates (1 mL of tar sands and oil per hour) were required. In another example, run under identical conditions except that the flow rate was 2 mL/hour, the hydrocarbon product had an API density of 17.8 and an unacceptably higher (77 ppm) nickel and vanadium content.

U.S. Pat. No. 2,135,332 (Gary) discloses a process for the cracking of relatively heavy oil, such as reduced crud.e, or a heavy gas oil consisting principally of constituents boiling above 700° F. (371° C.) to produce gases, liquids (lower boiling hydrocarbons of the gasoline range) and a solid or liquid residue including coke by admixing the heavy oil with a diluent such as steam, low boiling hydrocarbon gases or fixed gases at temperatures in the range of 650°–975° F. (343°–371° C.), followed by passing the preheated mixture to a zone wherein it is rapidly heated to a temperature in excess of 900° F. (>482° C.) followed by heating in another portion of the furnace at a temperature below the cracking temperature wherein the desired conversion is carried to completion. The converted products from the furnace are passed through a pressure letdown valve and forwarded thence to an evaporator where vapors separate from a residue which may be solid coke or liquid. In the evaporator, the residue is separated from the vapors and the vapors are forwarded to a fractionation zone to separate out the higher boiling components and recover liquid boiling in the gasoline range. Further, Gary discloses that coke is formed within the heating coil by conversion of heavy asphaltenes and viscous materials due to the higher temperature and prolonged heating within the heating zone, but that less coking difficulties are encountered within the heating coil when operating under this high temperature (>480° C.) and high pressure (2000–3000 psi) (13780–20670 kPa) conditions than are encountered under low temperature, low pressure conditions. However, Gary does not suggest a method of converting heavy oil containing high metal values, e.g., nickel and vanadium, into a light hydrocarbon oil substantially free of such metal values.

In addition, there are various catalytic processes for treating heavy hydrocarbons with water with specific externally supplied catalyst systems and externally supplied hydrogen at specified temperatures above the critical temperature to above the critical pressure of water.

SUMMARY OF THE INVENTION

The present invention provides a process for converting one or more heavy hydrocarbons into light hydrocarbons having increased hydrogen to carbon mole ratios as compared to the heavy hydrocarbon precursors. The process of this invention comprises:

(a) contacting heavy hydrocarbon, water, carbon monoxide and a "catalytically effective amount" of an "effective catalyst" at a temperature and pressure, and for a time sufficient to form a mixture comprising a residue and a phase comprising light hydrocarbon having an API gravity of between about 20 and 40 at 25° C., and having a hydrogen to carbon ratio greater than that of said heavy hydrocarbon, and which is substantially free of vanadium and nickel values, gas and water;

(b) separating said residue and said phase;

(c) separating said phase into a gas, and a liquid comprising water and said light hydrocarbon;

(d) recovering said light hydrocarbon product.

By virtue of the process of this invention, heavy hydrocarbons can be effectively converted into light hydrocarbons having increased hydrogen content.

As an additional advantage of the present invention, there is produced a minimum amount of gaseous product as well as a residue that is usually soluble in the heavy hydrocarbon starting material and that contains substantially no coke or pitch which would interfere with the operation of the present invention. Yet another advantage of the process of this invention is that it provides a light hydrocarbon having reduced sulfur and nitrogen content, and having relatively small amounts of metal contaminants.

DESCRIPTION OF THE PREFERRED EMBODIMENTS

In the first step of the process of this invention, a heavy hydrocarbon is contacted with water, carbon monoxide and a "catalytically effective amount" of an effective catalyst at a temperature and pressure and for time sufficient to form a mixture comprising a residue and a phase comprising light hydrocarbon, gas and water. Generally, carbon monoxide in a gaseous state is employed, and contacted under pressure with the components of the reaction mixture. The source of the carbon monoxide is not critical. The type of water employed is generally not critical, and can be varied widely. For example, water may be underground water, tap water, river water, lake water or the like, and may contain small amounts of salts accompanying the crude oil as obtained from the ground. While the presence of salt in the water may be tolerated, preferably the salt concentration is not greater than about 100 ppm.

Heavy hydrocarbons useful in the practice of this invention are those having an API gravity at 25° C. of less than about 20. Among the heavy hydrocarbons found useful in the process of the present invention are heavy crude oil, heavy hydrocarbons extracted from tar sands, commonly called tar sand bitumen, such as Athabasca tar sand bitumen obtained from Canada, heavy petroleum crude oils such as Venezuelan heavy oil, Boscan heavy oil, heavy hydrocarbon fractions obtained from crude petroleum oils particularly heavy vacuum gas oils, vacuum residue, petroleum tar and coal tar. This listing is merely representative of useful heavy hydrocarbons, and other heavy hydrocarbons having the specified API gravity value can be employed. The viscosity measured at 25° C. of the heavy hydrocarbon feedstock material may vary over a wide range. In the preferred embodiments, the viscosity is from about 1,000 to about 100,000 cp, and in the particularly preferred embodiments, is from about 20,000 cp to about 65,000 cp. Heavy hydrocarbons used in the conduct of the process of this invention often contain organometallic impurities. Among the organometallic impurities found in such heavy hydrocarbons, nickel and vanadium are most common although other metals including iron, copper, lead and zinc are often present. For example, such heavy hydrocarbon may contain from about 100 to about 2,000 ppm of vanadium and nickel. The heavy hydrocarbons used in the process may also contain various compounds containing sulfur and nitrogen, as for example, amines, mercaptans, thioethers, heterocyclic species containing sulfur and nitrogen, and the like.

The amount of water employed in the process can vary widely. In general, the heavy hydrocarbon to water volume ratio is greater than about 0.05. In the preferred embodiments of the invention, the heavy hydrocarbon to water volume ratio will vary from 0.05 to about 2.5, and in the particularly preferred embodiments will vary from about 0.1 to 1. Amongst these particularly preferred embodiments, most preferred are those embodiments in which the heavy hydrocarbon to water volume ratio varies from about 0.15 to about 0.5.

Similarly, the amount of carbon monoxide employed in the process can vary widely. In general, the weight ratio of carbon monoxide to heavy hydrocarbon is at least about 0.05. In the preferred embodiments of the invention, the weight ratio of carbon monoxide to heavy hydrocarbon will vary from about 0.05 to about 2, and in the particularly preferred embodiments, will vary from about 0.09 to about 6. Amongst these particularly preferred embodiments, most preferred are those embodiments of the invention in which the carbon monoxide to heavy hydrocarbon weight ratio varies from about 0.1 to about 0.4.

The heavy hydrocarbon, water and carbon monoxide are contacted in the presence of a "catalytically effective amount" of an "effective catalyst". As used herein, an "effective catalyst" is a catalyst which is capable of catalyzing the interaction between the heavy hydrocarbon, water and carbon monoxide such that any amount of the desired residue and phase is obtained. Effective catalysts are critical to an enhancement of the hydrogen to carbon mole ratio. Illustrative of effective catalysts are ferric oxide, sulfur, ferric sulfide, ferrous sulfide, sodium carbonate, pyrite and mixtures of sulfur and ferric oxide, mixtures of sulfur and pyrite, mixtures of sulfur and ferrous sulfide, mixtures of sulfur and ferric sulfide and the like. Preferred catalyst for use in the conduct of the process of this invention are ferric oxide, sulfur, ferric sulfide, ferrous sulfide and mixtures thereof, and particularly preferred catalyst are mixtures of sulfur and ferric oxide and/or ferric sulfide. Amongst these particularly preferred catalysts, most preferred are mixtures of ferric oxide and sulfur.

A "catalytically effective amount" of the effective catalyst is used. As used herein, a "catalytically effective amount" is an amount of the effective catalyst which is capable of catalyzing the interaction between the heavy hydrocarbon, water and carbon monoxide such that any amount of the desired residue and phase is obtained. The amount of catalyst employed can vary widely. In general, the amount of catalyst is usually at least about 0.1 weight percent based on the total weight of heavy hydrocarbon used. In the preferred embodiment, the amount of catalyst will vary from about 0.1 to about 10 weight percent based on the total weight of heavy hydrocarbon used. In the particularly preferred embodiments, the amount of catalyst will vary from about 0.3 to about 5 weight percent, and in the most preferred embodiments will vary from about 0.5 to about 3 weight percent on the aforementioned basis.

The heavy hydrocarbon, water and carbon monoxide are contacted under elevated temperature and pressure for a time sufficient to form the desired residue and phase. Contacting temperatures can vary widely. Usually, temperatures below about 325° C. are not employed because the rate of conversion of the heavy hydrocarbon into the residue and phase is not sufficiently high. In addition, temperatures above about 500° C. are not employed, unless excess water is used, because of the potential of coke formation. In the preferred embodiments of the invention, process temperatures will usually vary from about 350° C. to about 500° C., and in the particularly preferred embodiments, will vary from about 380° C. to about 480° C. Amongst these particularly preferred embodiments, most preferred are those embodiments in which process temperatures vary from about 400° C. to about 470° C.

Contacting pressures can also vary widely. Pressures are usually sufficiently high to allow phase separation after the pressure is removed from the system, and sufficiently high to promote reaction between carbon monoxide and water to any extent. The upper process pressure is not critical and will depend primarily on the availability of processing equipment capable of handling such pressures. In general, process pressures of from about 689 kPa (about 100 psig) to about 68,900 kPa (about 10,000 psig) are employed. In the preferred embodiments of the invention, the process pressure is from about 2756 kPa (about 400 psig) to about 24,115 kPa (about 3500 psig), and in the particularly preferred embodiments is from about 6,890 kPa (about 1000 psig) to about 17,225 kPa (about 2500 psig). Amongst these particularly preferred embodiments, most preferred are those embodiments in which the process pressure is from about 8957 kPa (about 1300 psig) to 13,780 kPa (about 2000 psig).

Contact times will vary widely, depending on the characteristics of the heavy hydrocarbon feedstock and the light hydrocarbon product desired. In general, contact times can vary from a few minutes to several hours or more. In the preferred embodiments, contact times will vary from about 1 minute to about 1 hour, and in the particularly preferred embodiments, will vary from about 1 minute to 20 minutes.

As used herein, "light hydrocarbon" means a hydrocarbon having an API gravity at 25° C. of greater than about 20, and preferably having an API gravity at 25° C. of between about 20 and about 40. The light hydrocarbon product obtained in accordance with the process of the present invention has a reduced vanadium and nickel content. Generally, the vanadium and nickel content of the light hydrocarbon product is equal to or less than about 50 ppm and is preferably less than about 30 ppm. The amount of organonitrogen and organosulfur compounds in the light hydrocarbon product are also reduced as compared to the amount of these materials in the original heavy hydrocarbon feedstock. In the preferred embodiments of the invention, the light hydrocarbon product is usually substantially free of organonitrogen compounds and usually contains only about 85% or less of the organosulfur compounds originally present in the heavy hydrocarbon feedstock. The viscosity of the light hydrocarbon product is less than that of the heavy hydrocarbon feedstock. In the preferred embodiments of the invention, the viscosity of the light hydrocarbon product is equal to or less than about 10 cp at 25° C., and in the particularly preferred embodiments, is equal to or less than about 5 cp. The hydrogen to carbon mole ratio of the light hydrocarbon is higher than the hydrogen to carbon mole ratio of the heavy hydrocarbon feedstock. In the preferred embodiments of the present invention, the light hydrocarbon has a hydrogen to carbon mole ratio equal to or greater than about 1.6, and in the particularly preferred embodiment, has a hydrogen to carbon mole ratio equal to or greater than about 1.7. In the most preferred embodiments, the light hydrocarbon product has a hydrogen to carbon mole ratio equal to or greater than about 1.8.

The gaseous product obtained by treatment of the heavy hydrocarbon in accordance with the process of the present invention comprises carbon dioxide, hydrogen sulfide, $C_1$–$C_6$ alkenes, $C_1$–$C_6$ alkanes and trace amounts of hydrogen. The amount of the gaseous product obtained is preferably no more than about 10 weight %, based on the weight of the heavy hydrocarbon feedstock.

The residue obtained by treatment of the heavy hydrocarbon in accordance with the process of the present invention is usually soluble in the feedstock heavy hydrocarbon. This residue is not a coke or pitch and as such may be used as a source of fuel. Moreover, this residue may be recycled or may be treated with steam or lower hydrocarbons, such as pentane, to remove light hydrocarbons that may be entrapped therein.

In the second, third and fourth steps of the process of this invention, the residue and phase are separated and the phase is then separated into the gaseous product, a liquid comprising water and the light hydrocarbon product which is recovered. Separation and recovery techniques are not critical and conventional techniques normally used to separate and recover such materials can be employed. Such techniques are well known in the art and will not be described in great detail. Illustrative of such techniques are those described in detail in U.S. Pat. No. 4,446,012, which is incorporated herein by reference.

The process of the present invention may be carried out either as a semi-continuous or batch process or as a continuous process. The reactants and reagents may be intially introduced into the reaction zone batchwise or they may be continuously or intermittently introduced in such zone during the course of the process. Means to introduce and/or adjust the quantity of reactants introduced, either intermittently or continuously into the reaction zone during the course of the reaction, can be conveniently utilized in the process, especially to maintain the desired molar ratio of the reaction solvent, reactants and reagents. In the continuous process, the heavy hydrocarbons, carbon monoxide and water are preferably fed under pressure to a preheated reaction or contacted zone wherein the temperature and pressure conditions are maintained for a time sufficient to form a residue and a phase containing the light hydrocarbon and gaseous products. The phase is continuously removed from the contact zone while the residue stream is continuously or periodically removed from the zone. The residence time in the zone may be varied from a few minutes up to about 20 minutes, depending upon characteristics of heavy hydrocarbon feedstock and light hydrocarbon product desired. In the batch process a total residence time of about 10 to about 20 minutes, preferably about 10 minutes, is used. In the continuous process, a total residence time of a few minutes to about 20 minutes, preferably from about 1 minute to less than about 3 minutes is used. In a continuous process, less gas is usually obtained than in the semi-continuous or batch process. In this continuous process usually less than about 10 weight %, preferably less than about 5 weight % and more preferrably less than about 2 weight % of the total products are gas.

The reaction zone employed is not critical. The reaction can be conducted in a single reaction zone or in a plurality-of reaction zones, in series or in parallel, or it may be conducted intermittently or continuously in an elongated tubular zone or a series of such zones. The materials of construction employed should be inert to the reactants during the reaction, and the fabrication of the equipment should be able to withstand the reaction temperatures and pressure. In some instances, it may be desirable to provide the reaction zone or zones with a packed bed of inert materials such as particles of granite, sand, porcelain or bed saddles.

The reaction zone can be fitted with one or more internal and/or external heat exchanger(s) in order to control undue temperature fluctuations, or to prevent any possible "runaway" reaction temperatures. In preferred embodiments of the process, agitation means to vary the degree of mixing the reactions mixture can be employed. Mixing by vibration, shaking, stirring, rotation, oscillation, ultrasonic vibration or the like are all illustrative of the type of agitation means contemplated. Such means are available and well known to those skilled in the art.

The light hydrocarbons manufactured by the process of the invention can be used for the same purposes as other light hydrocarbons. For example, some of these light hydrocarbons have a carbon distributive number similar to that of gasoline, kerosene and diesel oil, and as such can be reformed into these materials at low catalyst consumption ratio.

The following specific example is provided to more particularly illustrate the process of this invention and should not be construed as a limitation thereon.

EXAMPLE

In a batch process, the process of this invention was conducted using various catalysts and heavy hydrocarbon feedstocks. In these experiments, 50 grams of boscan heavy oil (hydrogen to carbon mole ratio of 1.51) or cold lake bitumen (hydrogen to carbon mole ratio of 1,51), 20 gm of water, 17 gm of carbon monoxide and 2 gm of a catalyst selected from the group consisting of sulfur ($S_8$), ferric oxide ($Fe_2O_3$), pyrite (FeS) and mixutures of $S_8/Fe_2O_3$ and $S_8$/FeS were charged into a 300 ml autoclave, and heated at a temperature of 410° C. and a pressure of 24,115 kPa (3500 psi) for 5 minutes. Two experiments were conducted for comparison purposes in which no catalyst was used. The mixture was then allowed to cool to room temperature. The formation of carbon dioxide was monitored by gas analysis. The light hydrocarbon product was extracted with trichloroflurometh ane and was isolated by vacuum distillation. The isolated product was analyzed and its hydrogen to carbon mole ratio was determined. The results of these experiments are set forth in the following Table I.

TABLE I

| Expt. No. | Catalyst | H/C Mole Ratio of Light Oil | Heavy Oil | Moles of $CO_2$ |
|---|---|---|---|---|
| 1 | None | 1.60 | Boscan Heavy Oil | 0.027 |
| 2 | Sulfur | 1.70 | Boscan Heavy Oil | 0.073 |
| 3 | Pyrite | 1.75 | Boscan Heavy Oil | 0.036 |
| 4 | Pyrite/Sulfur | 1.78 | Boscan Heavy Oil | 0.125 |
| 5 | $Fe_2O_3$/Sulfur | 1.80 | Boscan Heavy Oil | 0.21 |
| 6 | None | 1.69 | Cold Lake Bitumen | 0.013 |
| 7 | $Fe_2O_3$/Sulfur | 1.78 | Cold Lake Bitumen | 0.21 |

What is claimed is:

1. A process for converting heavy hydrocarbon into light hydrocarbon which comprises:

(a) contacting heavy hydrocarbon having an API gravity at 25° C. of less than about 20 with a liquid comprising water, and carbon monoxide in the presence of a catalyst consisting essentially of a mixture of sulfur and one or more materials selected from the group consisting of ferric oxide, ferric sufide, ferrous sulfide and pyrite at a temperature and at a pressure and for a time sufficient to form a mixture comprising a residue and a phase comprising gas, water, and light hydrocarbon having a hydrogen to carbon ratio greater than that of said heavy hydrocarbon and having an API gravity at 25° C. of greater than about 20;

(b) separating said resuidue and said phase;

(c) separating said phase into a gas, and a liquid comprising water, and said light hydrocarbon; and (d) recovering said light hydrocarbon.

2. The process of the claim 1 wherein said catalyst is selected from the group consisting of mixtures of ferric oxide and sulfur, and pyrite and sulfur.

3. The process of claim 2 wherein said catalyst is a mixutre of ferric oxide and sulfur.

* * * * *